US005338095A

United States Patent [19]

Laughlin et al.

[11] Patent Number: 5,338,095

[45] Date of Patent: Aug. 16, 1994

[54] UPHOLSTERED SEATING SYSTEM

[75] Inventors: Glenn M. Laughlin, High Point, N.C.; Jeffrey A. Frank, Arlington, Va.; Bruce Hirschhaut, High Point, N.C.

[73] Assignee: JBG Original Designs Incorporated, High Point, N.C.

[21] Appl. No.: 846,022

[22] Filed: Mar. 5, 1992

Related U.S. Application Data

[63] Continuation-in-part of Ser. No. 720,369, Jun. 25, 1991, Pat. No. 5,263,764.

[51] Int. Cl.[5] ..... A47C 7/00

[52] U.S. Cl. ..... 297/440.1; 297/452.18

[58] Field of Search ..... 297/446, 452, 218, 219, 297/443, 444, 440.1, 218, 219.1, 440.15, 440.16, 440.2, 440.21

[56] References Cited

U.S. PATENT DOCUMENTS

| | | | |
|---|---|---|---|
| 2,914,118 | 11/1959 | Sawyers | 297/440 |
| 3,129,472 | 4/1964 | Hensel . | |
| 3,774,966 | 11/1973 | Faulkner et al. | 297/440 |
| 3,786,657 | 9/1973 | Johnson | 297/440 |
| 3,799,611 | 3/1974 | Steinfeld . | |
| 3,951,558 | 4/1976 | Komarov . | |
| 3,966,340 | 6/1976 | Morris . | |
| 4,012,155 | 3/1977 | Morris . | |
| 4,025,216 | 5/1977 | Hives . | |
| 4,204,287 | 5/1980 | Lane et al. . | |
| 4,261,667 | 4/1981 | Ervin et al. . | |
| 4,292,003 | 9/1981 | Pond . | |
| 4,305,616 | 12/1981 | Martinez | 297/440 |
| 4,395,071 | 7/1983 | Laird | 297/440 |
| 4,621,301 | 11/1986 | Schramek | 297/440 X |
| 4,711,495 | 12/1987 | Magder . | |
| 4,883,331 | 11/1989 | Mengel . | |
| 4,886,326 | 12/1989 | Kuzyk . | |
| 4,893,958 | 1/1990 | Wieland . | |
| 4,919,485 | 4/1990 | Guichon | 297/440 X |
| 4,944,627 | 7/1990 | Durney . | |
| 5,069,506 | 12/1991 | Wieland . | |
| 5,080,438 | 1/1992 | Moyer | 297/440 |
| 5,135,284 | 8/1992 | Crum . | |

OTHER PUBLICATIONS

Flotura Sleeper Fixture With Universal Mounting Plate, 1979.

Mounting Dimensions Model 900 Sleeper, 1979.

Promotional All-Link Flotura 43275 Series, 1979.

Low Cavity Flotrua 43795 Series, 1979.

*Primary Examiner*—Jose V. Chen

*Attorney, Agent, or Firm*—Spencer, Frank & Schneider

[57] ABSTRACT

An upholstered chair or sofa capable of being quickly and easily assembled and disassembled which includes first and second spaced arm members, front and back members interposed between the first and second arm members, and a seat member supported by the arm members and the front member without being attached thereto. Attachment structures are provided for connecting the first and second arm members to the back member, the attachment structures serving solely for securing the first and second arm members to the back member without supporting the seat member. In addition, in one embodiment of the invention the attachment structures also secures the first and second arm members to the front member without supporting the weight of the seat member.

19 Claims, 13 Drawing Sheets 122
132b
142
169
167
198
150
164
166
165
168
171
178
176
174
186
154
182
185
126
194
183
172
194'
183'
172'
182'
184'
186'
185'

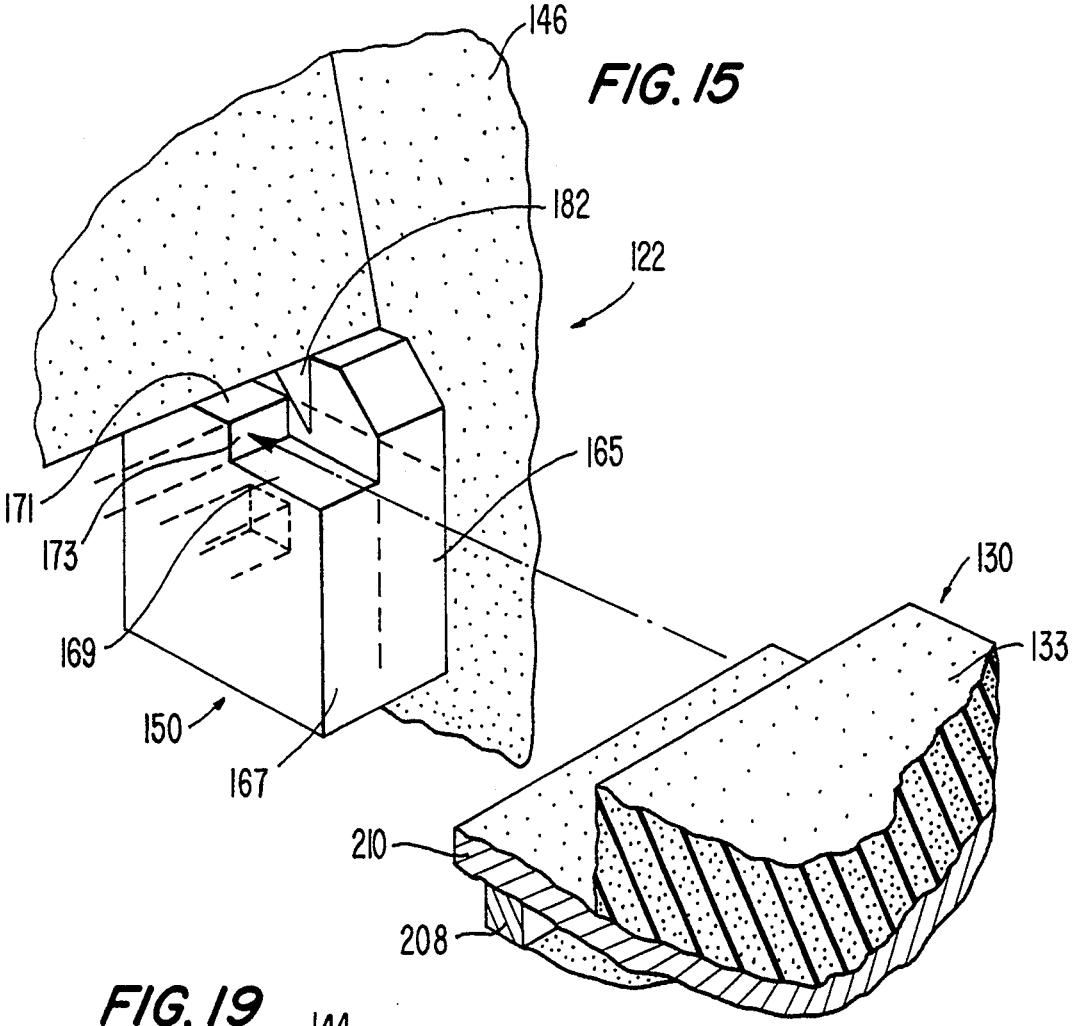
FIG. 15
FIG. 19
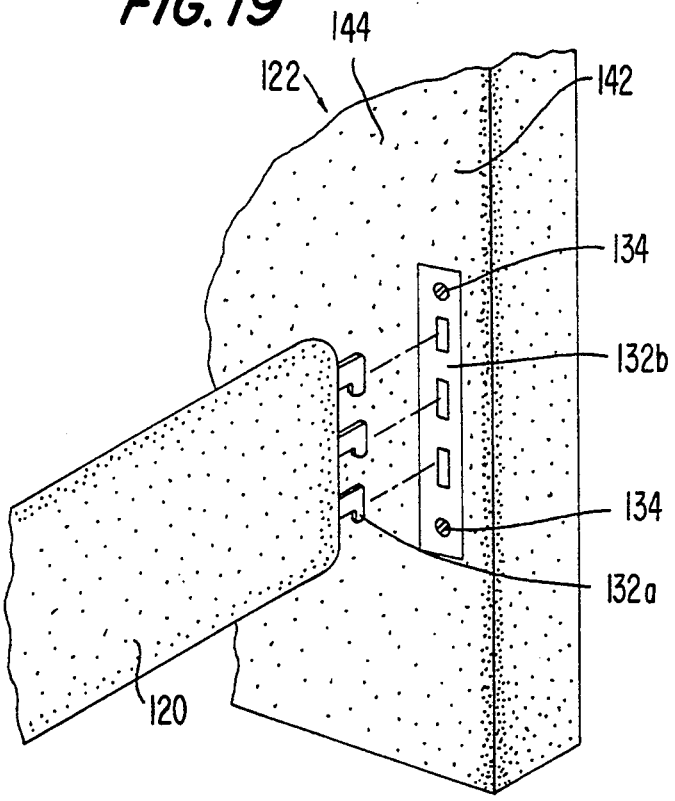

UPHOLSTERED SEATING SYSTEM

This application is a continuation-in-part of Ser. No. 07/720,369 filed Jun. 25, 1991, now U.S. Pat. No. 5,263,764.

BACKGROUND OF THE INVENTION

This invention relates to upholstered furniture, and in particular to an upholstered seating system capable of being quickly and easily assembled and disassembled.

Conventional upholstered seating systems such as chairs and sofas utilize a fully assembled frame having a seat, a front rail, a back, and two arms. The frame is covered by a fabric covering, and upholstery consisting of materials such as fiber and foam are attached to the fabric covering. Springs, webbing or other means of support are permanently attached below the seat to the front and back rails.

Shipping is usually expensive because conventional upholstered furniture is large, bulky and heavy. In addition, damage to any portion of the furniture requires the entire piece to be transported to a skilled person for repair. Attempts have been made to minimize these problems by constructing furniture in such a way that it can be assembled and taken apart by unskilled persons such as a customer or store owner. This type of furniture, including seating systems, is generally known in the trade as "knock-down" or KD furniture.

Prior art KD upholstered furniture has been designed to permit assembly and subsequent disassembly. This type of furniture relies upon a series of joints and fasteners which often are visible to the casual observer. These joints, which can be loose and weak, make the furniture appear inexpensive and detract from its overall strength and appearance. Most KD upholstered furniture uses exposed wood frames and exposed fasteners. It is far more difficult to build a KD chair or sofa which is completely upholstered with no exposed hardware or fasteners.

Previous efforts to design KD upholstered furniture without visible fasteners have resulted in a product which is time consuming and difficult for the unskilled customers to assemble, more expensive than comparably styled conventional upholstered furniture, requires a plurality of fasteners to maintain structural integrity, and is limited in the number of styles that can be generated from a basic design. Often bolts and other fasteners must be accessed from the bottom of the piece.

For example, the Moyer U.S. Pat. No. 5,080,438 represents an attempt to produce a knockdown upholstered piece of furniture with strong durable construction and imperceptible joints. This design would appear to require at least eight bolts or studs which must apparently be tightened from the bottom of the piece using hand tools. Consequently, the bottom of the seat platform must be left uncovered to allow access to the supporting bolts, which means that the seat platform cannot be supported by common industry techniques such as coil springs since they would inhibit access to the seat platform and the bolts.

The entire weight of the person sitting on the patented structure is supported by four bolts connecting the seat section to the arms. If the seat section is pitched towards the rear (as is done in high quality conventional permanently assembled upholstery), a high proportion of the sitter's weight is borne by the rear two seat platform bolts.

The patented design also restricts the furniture styles which can be used. Using the furniture structure disclosed by Moyer it would be difficult if not impossible to construct a high leg traditional style piece (such as a wing chair) or one having a T-shaped cushion or a recessed arm, i.e. where the arm stops prior to the front of the seat platform.

An attempt to simplify the assembly procedure is shown in the Faulkner et al. U.S. Pat. No. 3,774,966. The sofa described in this patent has an assembly system employing specially designed hardware and fasteners which support the weight of persons sitting on the sofa. There are several commercial drawbacks to this design. Besides the high cost of the special guide rails required for the back assembly, the sofa is highly restricted in terms of style.

The back construction with its rectangular metal frame and attached back envelope gives the piece an unpadded back, cushioned only by the back pillow, allowing for few variations in styling. Only loose back cushions can be used with the described back frame and envelope. An attached or semi-attached back cushion can not be used with the Faulkner design. In addition, the fasteners on the rear of the back envelope can be seen.

Another drawback of the Faulkner design is that assembly must take place from the bottom of the sofa. This requires some strength and agility on the part of the assembler which might not be possible for some customers. The Faulkner patent, also, is not adaptable for high leg traditional, "T" cushion or recessed arm styles.

The Hsiung U.S. Pat. No. 4,691,965 attempts to deal with the special problems of manufacturing KD high leg traditional chairs. The patentees's solution is to use numerous bolts and fasteners requiring a relatively long time to assemble.

SUMMARY OF THE INVENTION

An object of the present invention is to provide a KD upholstered seating system which is easy to assemble and disassemble, and yet is virtually indistinguishable in looks and comfort from conventional permanently assembled upholstered furniture.

Another object of the invention is to provide a KD seating system in which the weight of the furniture and the user thereof is borne by the frame rather than bolts or other fastening devices used to hold the frame components together.

Still another object is to provide a KD seating system which can be used to emulate virtually any conventional permanently assembled upholstered furniture style, and which can be incorporated into chairs, loveseats, sofas, sleep sofas or other furniture structures.

The present invention provides a KD upholstered seating system with interchangeable parts that can be assembled quickly and easily from the front of the piece by a single unskilled person without tools and without turning the piece up-side-down or on its side, front or back. When assembled, the appearance, comfort and strength of the present invention are indistinguishable from conventional upholstered furniture. No specially designed hardware or fasteners are required.

The invention relies upon an interlocking system in which the weight of the various parts of the furniture and the sitter thereon is substantially distributed throughout the frame of the furniture, and in which very little stress is placed upon any of the attachment devices.

Two alternative front attachment methods are provided which may be substituted as needed for various styles of furniture. One is suitable for all styles in which the arms are aligned with the front panel of the piece and the other is used when recessed arms, "T" cushions high leg or exposed leg styles are required.

Because the present invention does not require access through the bottom of the seat platform or the back, there is no limitation on seat or back support systems. Webbing, no-sag springs, coil springs, fabric sheeting, Dymetrol, sleeper mechanisms and all other conventional support methods may be used as desired.

The aforesaid and other objectives are realized by a furniture structure which consists of a back, front, seat and side sections which are upholstered and ready to assemble by unskilled persons. More specifically, the invention comprises an upholstered chair or sofa capable of being quickly and easily assembled and disassembled which includes first and second spaced arm members, front and back members interposed between the first and second arm members, and a seat member supported by the arm members and the front member without being attached thereto. Attachment means are provided for connecting the first and second arm members to the back member, the attachment means serving solely for securing the first and second arm members to the back member without supporting the seat member. In addition, in one embodiment of the invention the attachment means also secures the first and second arm members to the front member without supporting the weight of the seat member.

BRIEF DESCRIPTION OF THE DRAWINGS

FIGS. 15 and 16 are exploded perspective and elevational fragmentary views, respectively, showing one way of attaching the back, arm and seat members of the chair of FIG. 11.

FIG. 19 is a perspective fragmentary view illustrating the right front corner of the chair of FIG. 11.

DESCRIPTION OF THE PREFERRED EMBODIMENTS

Figure 1:
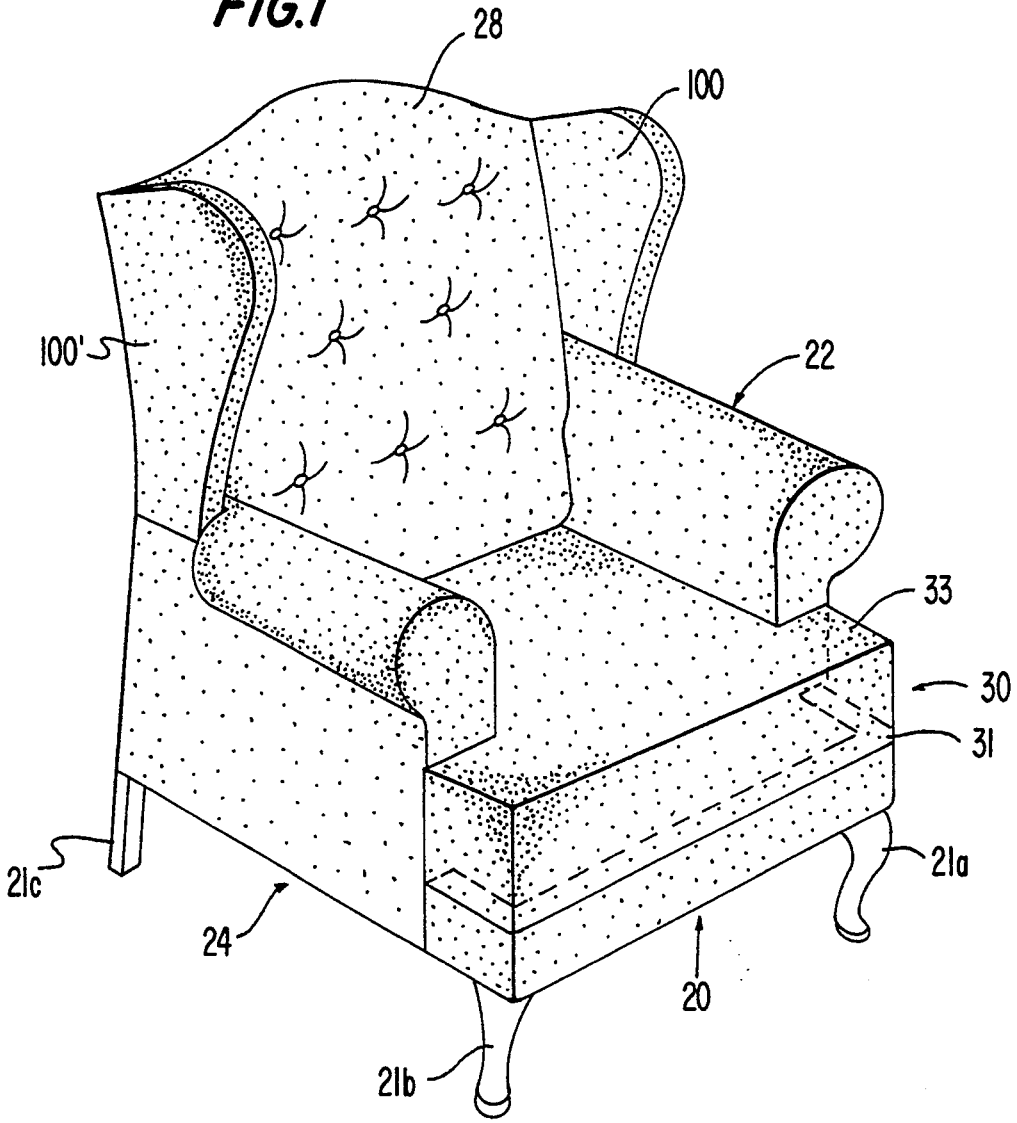
FIG. 1 is a perspective front view of a wing chair embodying the invention.

In the following description, the terms "vertical" and "horizontal" refer to the directions substantially perpendicular and parallel respectively to a floor on which a chair is placed. Also, the described chairs are symmetrical; therefore, for clarity some of the drawing figures show only the right-hand components as viewed from the front of the chair, the left-hand components being mirror images of the right-hand components. In general, the right hand components are identified by unprimed numbers and the left-hand components, whether illustrated or not, are identified by primed numbers.

FIG. 1 illustrates an assembled wing chair employing our invention. As viewed from the front, the chair comprises a front member 20, a first or right-hand vertical arm member 22 and a second or left-hand vertical arm member 24 spaced apart from the right-hand member 22. A back member 26 (FIG. 2) is interposed between the arm members 22 and 24, and a back cushion 28 and seat member 30 are provided. Legs 21*a* and 21*b* extend from the right and left ends of the front member 20, and legs 21*c* and 21*d* (FIG. 2) extend from the back member 26.

Figure 2:
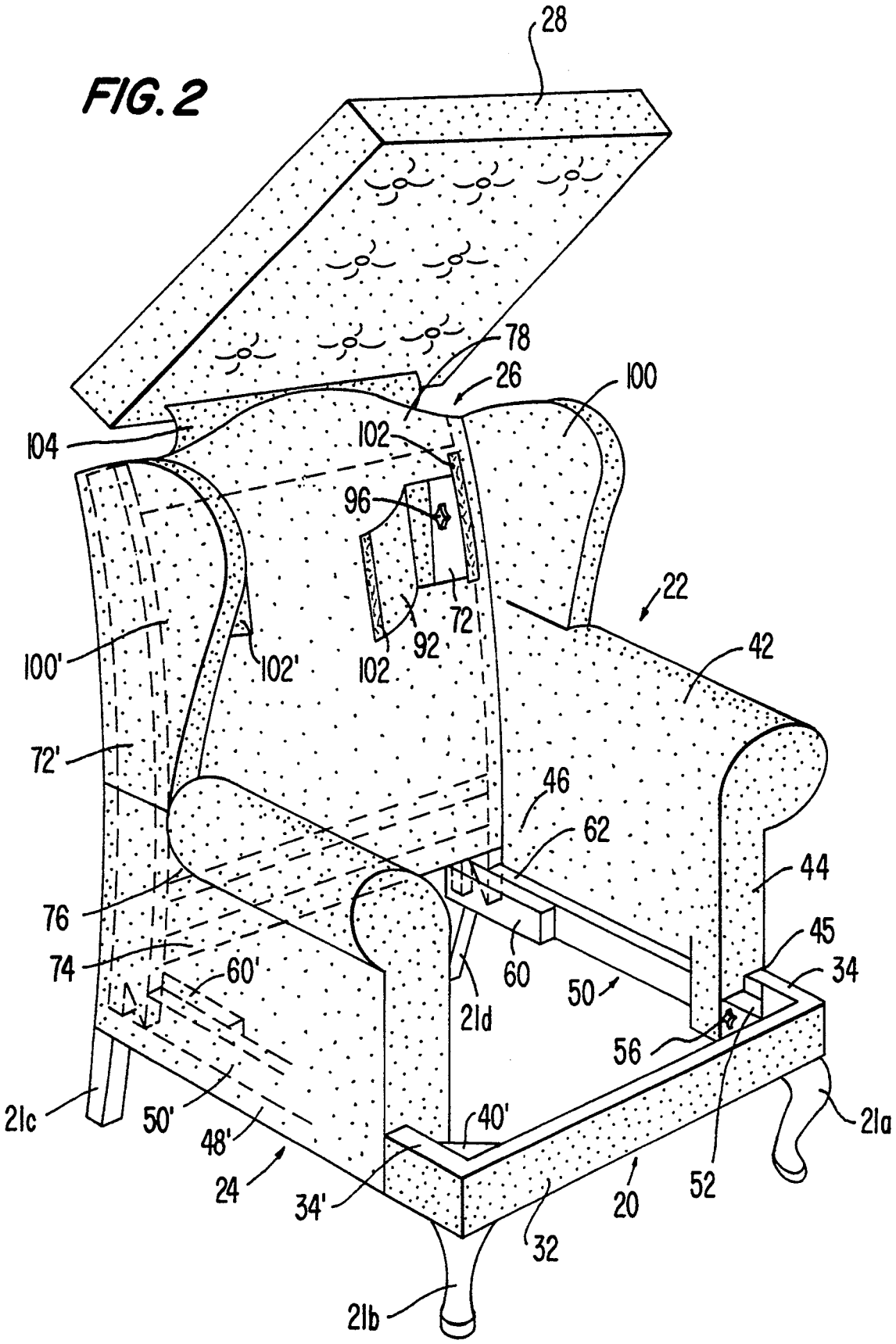
FIG. 2 is a perspective front view of the chair of FIG. 1 in a partially disassembled condition.
Figure 9:
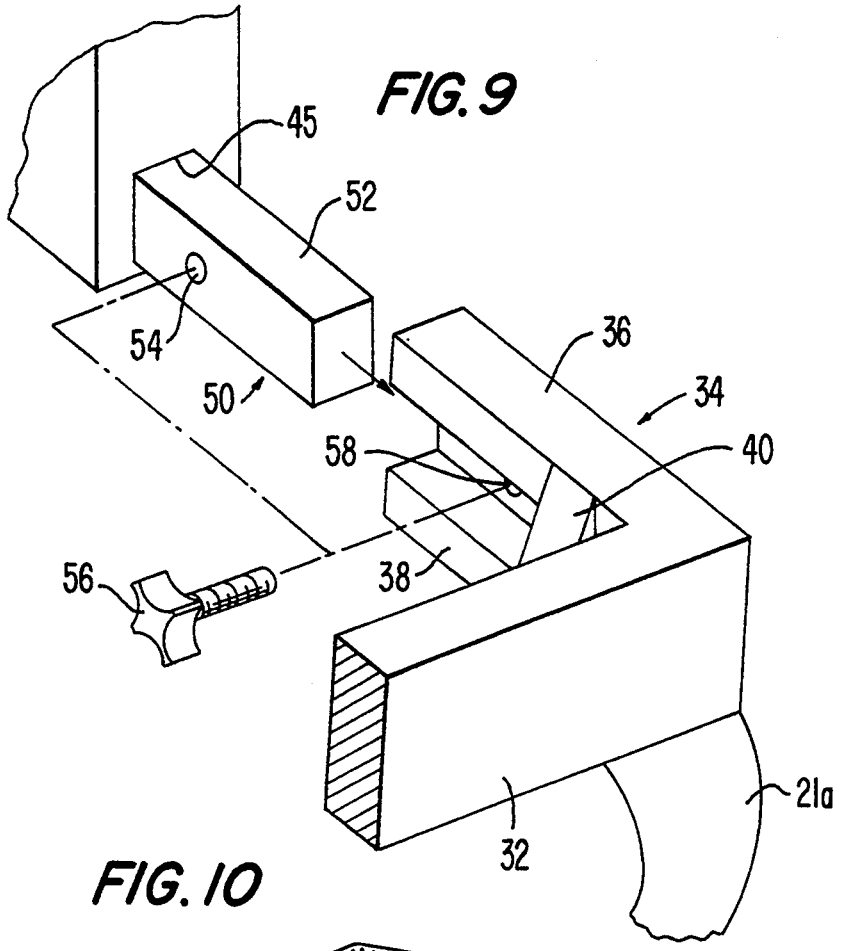
FIG. 9 is a perspective fragmentary view illustrating the right front corner of the chair of FIG. 1.
Figure 10:
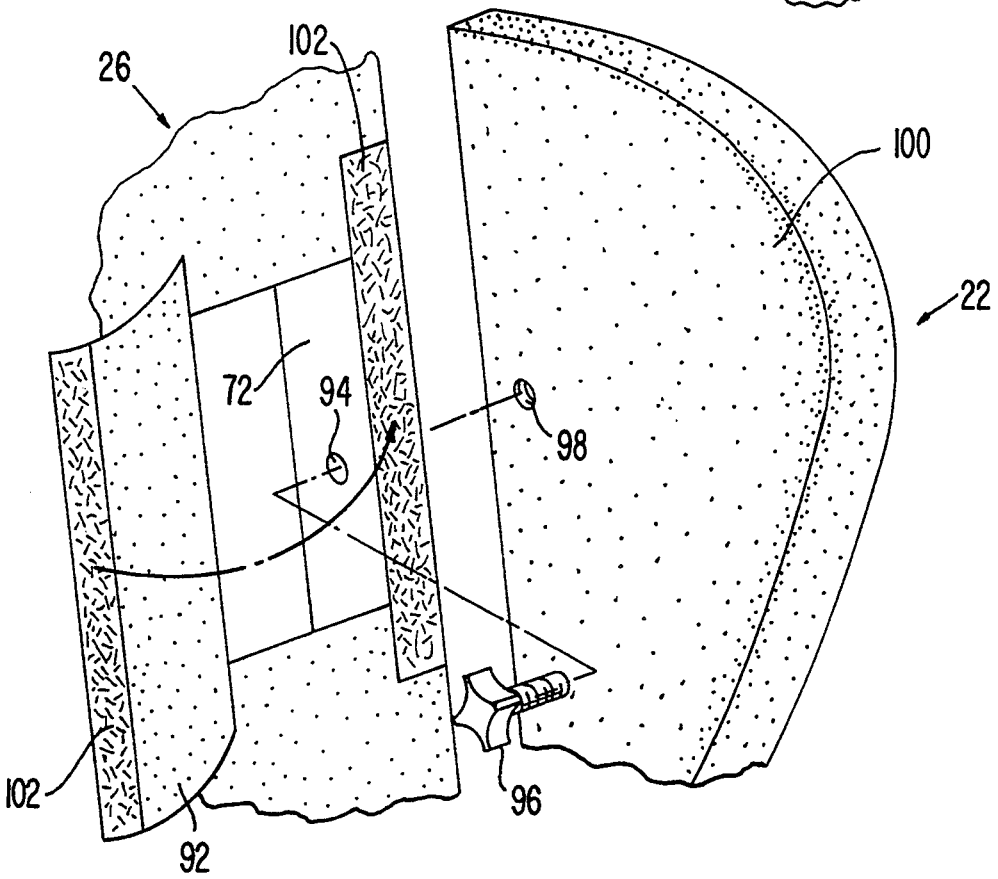
FIG. 10 is a perspective fragmentary view of the back and right-hand arm member of the chair of FIG. 1.

Referring to FIGS. 2 and 9, the front member 20 comprises a front section 32, a first channel section 34 extending from the right side of the front section and a second channel section 34' extending from the left side of the front section. The first channel section 34 is provided with upper and lower flanges 36 and 38 respectively, and corresponding flanges 36' and 38' (not shown) are provided on the second channel section 34'. A corner brace 40 is secured between the front section 32 and channel section 34, and a corner brace 40' is located between front section 32 and channel section 34'.

Figure 3:
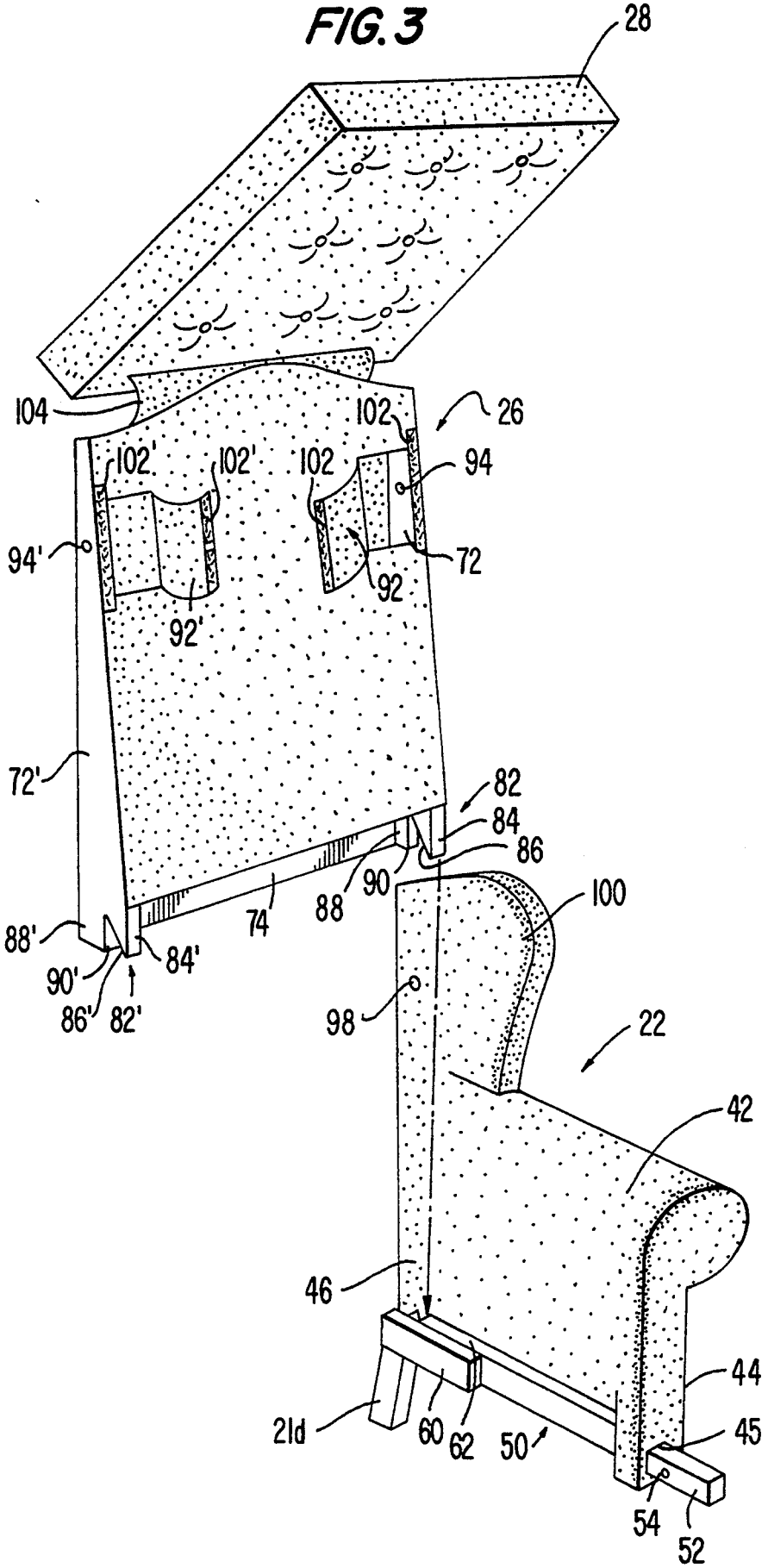
FIG. 3 is a perspective front exploded partial view of the chair of FIG. 1 illustrating the back and right-hand arm members.
Figure 5:
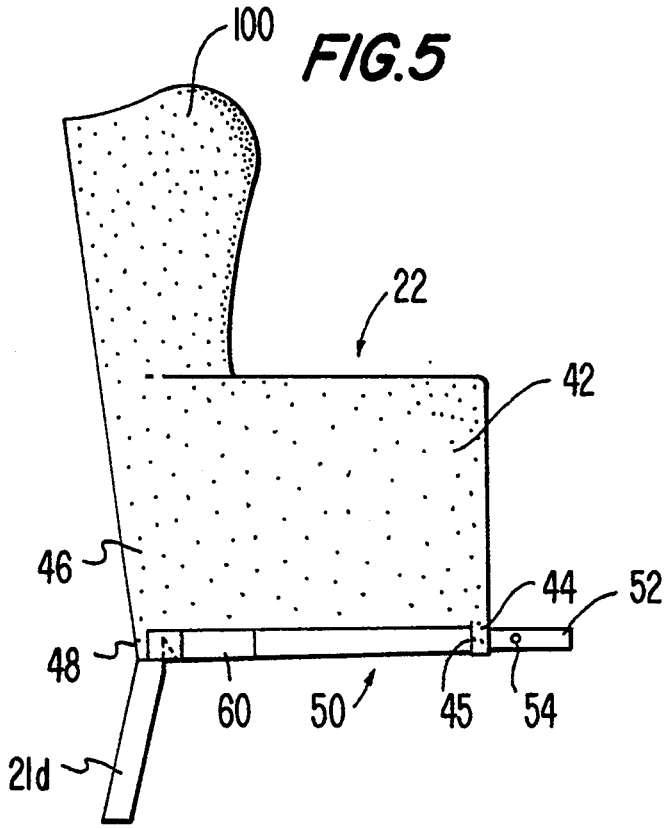
FIG. 5 is an elevational view showing the inner surface of the right-hand arm member of the chair of FIG. 1.

As shown in FIGS. 2, 3 and 5, the right-hand arm member 22 has an inner surface 42, a front portion 44 having a horizontally extending aperture 45 therein, a rear portion 46 and a lower edge 48 extending between the front and rear portions 44 and 46 respectively. Similarly, the left-hand arm member 24 is provided with a corresponding inner surface 42', a front portion 44' having an aperture 45' therein, a rear portion 46' and a lower edge 48'.

A side support or rail member 50 is attached to the lower edge 48 of the inner surface 42 of right-hand arm member 22. A forward section 52 of rail member 50 projects through the aperture 45 in arm member 22, and the forward section 52' of a corresponding side support or rail member 50' (shown in dashed lines in FIG. 2) projects through a corresponding aperture 45' in right-hand arm member 24. A hole 54 (see also FIG. 9) is located in the forward section 52 of rail member 50 to permit insertion of a thumbscrew 56 for engagement with a threaded insert 58 in the channel section 34 for a purpose to be explained hereinafter. A corresponding hole 54' thumb screw 56' and threaded insert 58' are provided for the components on the left-hand side of the chair.

Figure 6:
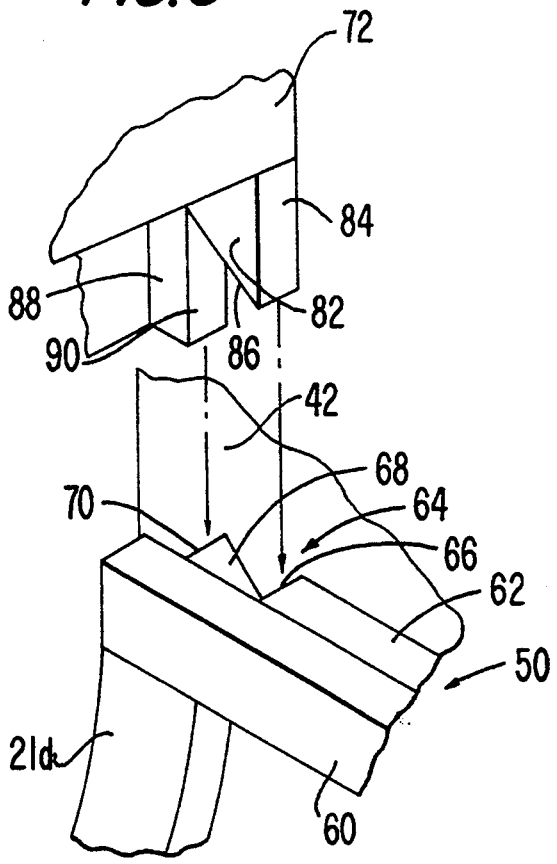
FIG. 6 is a perspective fragmentary view showing how the back member of chair of FIG. 1 is attached to the right-hand arm member.
Figure 7:
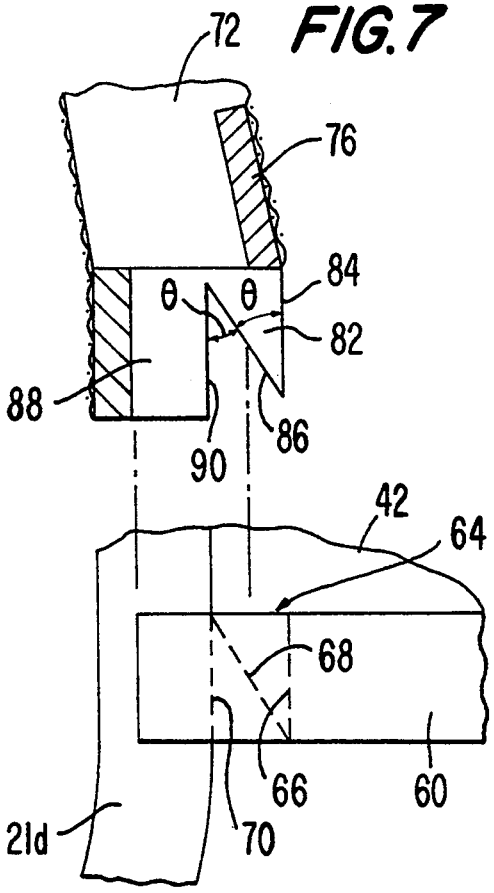
FIG. 7 is an elevational fragmentary view corresponding to the view of FIG. 6.

A seat support member 60 is attached to a rearward section 62 of the rail member 50, and a seat support member 60' is attached to the rearward section of rail member 50'. As best shown in FIGS. 6 and 7, a wedge-shaped socket 64 is provided in the rearward section 62 of rail member 50. Socket 64 is defined by a substantially vertical surface 66 and a sloping surface 68 which makes an acute angle $\theta$ with the vertical surface 66. The seat support member 60, which extends to the rear beyond the end 70 of rail member 50, and the inner surface 42 of arm member 22 function as spaced walls of the socket 64. A similar wedge-shaped socket 64' and seat support member 60' are provided for the left-hand arm member 24.

Figure 8:
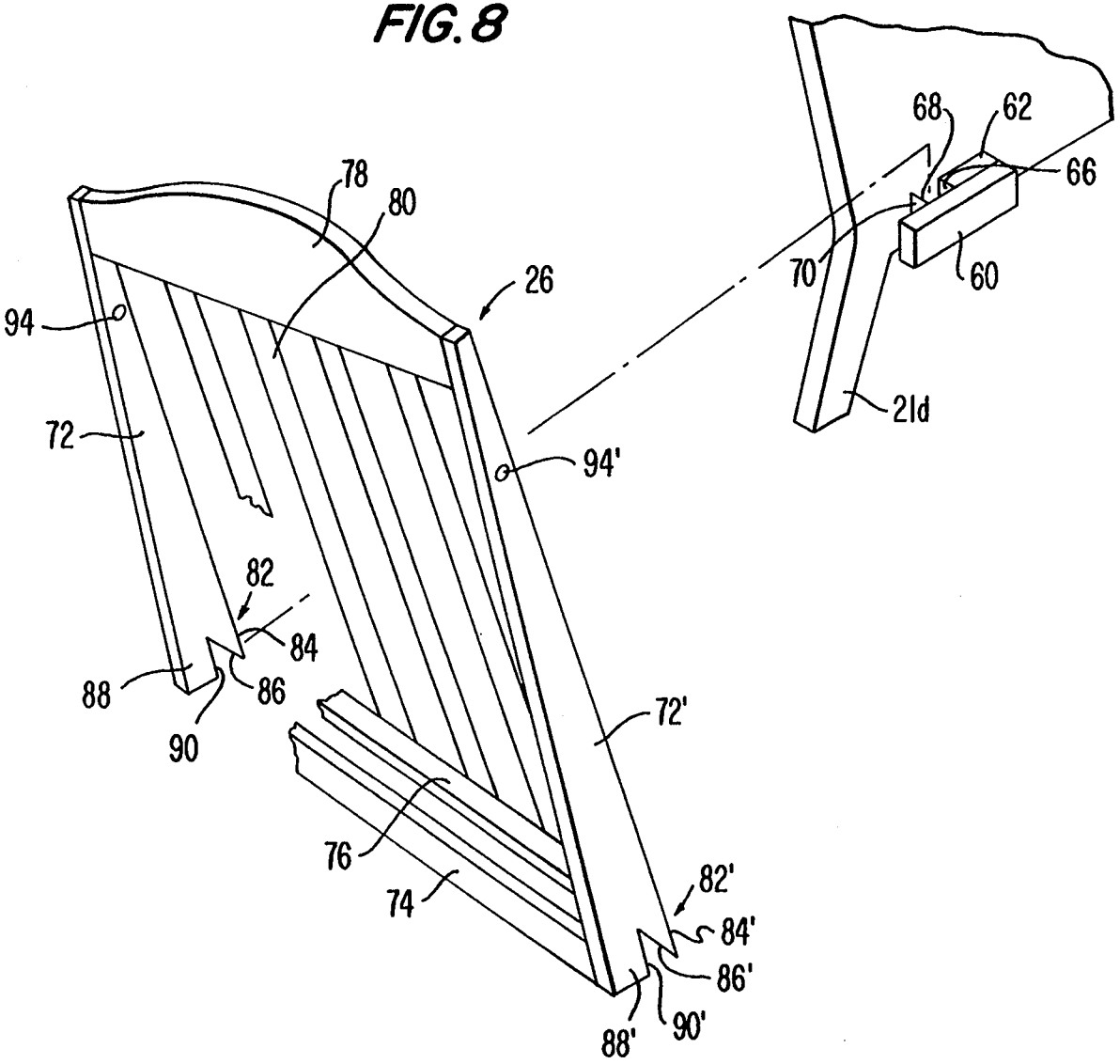
FIG. 8 is an exploded perspective view showing the back member with the upholstery removed and a portion of the right-hand member of the chair shown in FIG. 1.

Referring to FIG. 8, the back member 26 is shown with the upholstery removed. The back member 26 comprises right and left-hand vertical side members 72 and 72' respectively, a horizontal bottom rail 74, an intermediate rail 76 and a horizontal top rail 78, the rails 74, 76 and 78 being interposed between the vertical side members 72 and 72'. Webbing 80 is attached between the horizontal top rail 78 and the intermediate rail 76. Alternatively, springs, fabric sheeting or other support materials may be used instead of webbing.

As shown in FIGS. 3 and 6-8, the lower ends of the vertical side members 72 and 72' are provided with wedge-shaped projections 82 and 82' respectively. Projection 82 is defined by a vertical surface 84 and a sloping surface 86 which makes an acute angle 8 with the surface 84, and projection 82' is defined by a vertical surface 84' and a sloping surface 86' which makes an acute angle $\theta'$ with the vertical surface 84'. The lower ends of the vertical side members 72 and 72' are also provided with projections 88 and 88' having the general shape of rectangular parallelepipeds with sides 90, 90'. Sides 90, 90' of projections 88, 88' make acute angles 8 with sloping surfaces 86, 86' of projections 82, 82', as shown in FIGS. 6 and 7.

With reference to FIGS. 2, 3, 8 and 10, the back member 26 is provided with flaps 92 which provide access to holes 94 and 94' in vertical side members 72 and 72'. Hole 94 permits a thumb screw 96 to engage a threaded insert 98 in wing portion 100 of arm member 22. Similarly, hole 94' permits a thumb screw 96' to engage a threaded insert 98' in the wing portion 100' of arm member 24. Hook-and-loop strips 102, such as Velcro or Aplix, are provided on the edges of flaps 92 and on the upholstery of the back member 26 to permit closure of the flaps thereby concealing the thumb screws 96 and 96' from view.

Figure 4:
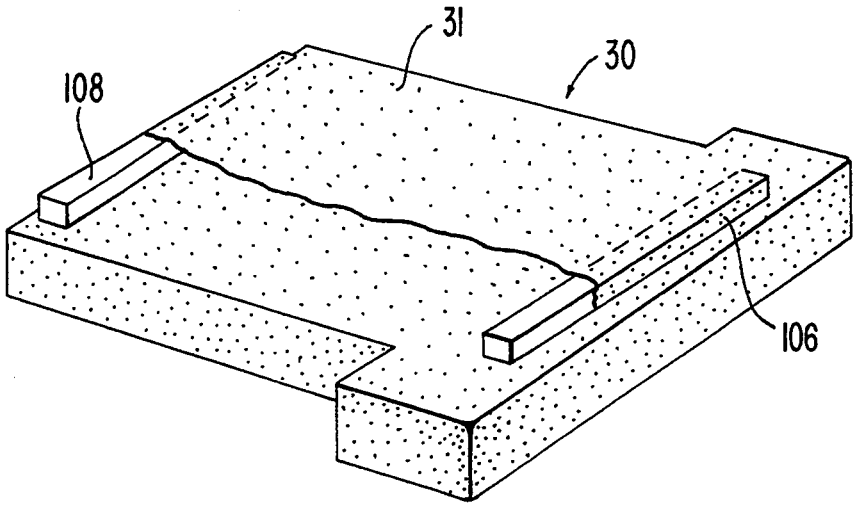
FIG. 4 is a perspective view of the bottom of a seat member for the chair shown in FIG. 1.

In one embodiment of the wing chair of this invention, the back cushion 28 is connected to the back member 26 by a strip 104 of fabric, as shown in FIGS. 2 and 3. The seat member 30 is composed of a seat platform 31 and a seat cushion 33, the seat platform 31 (FIG. 4) being provided with front and rear stabilizer members 106 and 108. The seat member 30 is in the shape of a "T", and extends beyond the front of the arm members 22 and 24. The front of the cushion 33 and the seat platform 31 are supported by and flush with the front member 20.

To assemble the chair, the forward sections 52 and 52' of the rail members 50 and 50' of the right and left-hand arm members 22 and 24 are inserted between the upper and lower flanges 36, 38; 36', 38' of the channel sections 34 34' of the front member 20. To permit the forward sections 52, 52' to be brought flush with the inside of the front section 32 of the front member 20 the corner inserts 40 and 40' have apertures (not shown) adjacent the channel sections. Thumb screws 56 and 56' are then inserted in holes 54 and 54' of forward sections 52 and 52' and engaged with threaded inserts 58 and 58' in the channel sections.

The back member 26 is next lowered on to the rearward sections 62, 62' of the rails members 50, 50' so that the wedge-shaped projections 82 and 82' at the lower ends of the vertical side members 72 and 72' of the back member mate with the wedge-shaped sockets 64, 64'. Specifically, the sloping surfaces 86, 86' and the vertical surfaces 84, 84' of projections 72, 72' are brought into contact with the sloping surfaces 68, 68' and the front vertical surfaces 66, 66' of sockets 64 and 64'. The rectangular parallelepiped-shaped projections 88, 88' of vertical side members 72, 72' extend behind and below the ends 70, 70' of rails 50, 50' with their sides 90, 90' in contact with the ends 70, 70'. Thumb screws 96 and 96' are then inserted in holes 94 and 94' and are engaged with the threaded inserts 98, 98' in the wing portions 100, 100' of the arm members 22 and 24, and the flaps 92 closed using the hook-and-loop strips 102. The back cushion 28 is then rotated downward to cover the front of the back member 26.

The assembly is completed by inserting the seat member 30 so that it rests on the rail members 50, 50' and seat support members 60, 60' between the arm member 22, 24, the rear seat stabilizer 108 presses against the horizontal bottom rail 76 of the back member 26 and under the back cushion 28, and the front stabilizer 106 is wedged behind the front member 20 thereby preventing the seat platform 31 from sliding in any direction. In a preferred form of the invention, the front legs **21*a* and 21*b* are slightly longer than the rear legs 21*c* and 21*d* so that the rail member 50, 50' slope slightly toward the back of the chair which causes the seat member 30** to be lower at the back than at the front. This configuration, which is found in high quality conventional furniture, results in greater comfort for a person sitting on the chair.

An important feature of our invention is that, unlike conventional KD chairs, the weight of the chair and that of a person seated on the seat cushion is not transferred to the chair legs through bolts but rather directly by the free. This occurs because in our invention the combined weight of the chair frame and person seated on the chair is transferred to the legs through the arm and front members.

Backward rotational forces generated, for example, when a person leans back against the back member 26 are opposed by the upper flanges 36, 36' of the front sections 34, 34' and by the pressure of the sides 90, 90' of the projections 88, 88' and vertical surfaces 84, 84' on the rearward ends 70, 70' and the front vertical surfaces 66, 66' of the rail members 50, 50' respectively.

Lateral movement is resisted by cooperation between the seat support members 60, 60' and the arm members 22, 24 between which the projections 88, 88' are interposed. The thumb screws also oppose lateral motion of the arm members and do not support vertical forces.

Figure 11:
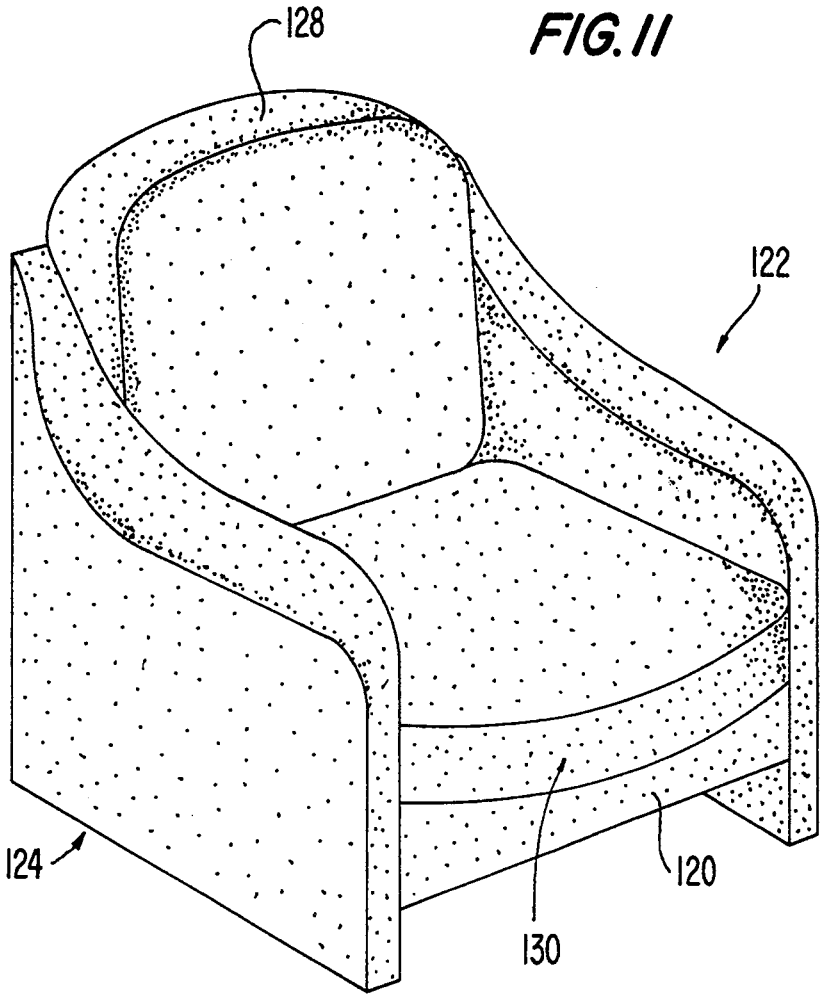
FIG. 11 is a perspective front view of another type of chair embodying the invention.

FIG. 11 illustrates another type of assembled chair employing our invention. As viewed from the front, this chair comprises a front member 120, a first or right-hand vertical arm member 122 and a second or left-hand vertical arm member 124 spaced apart from the right-hand member 122. A back member 126 (FIG. 13) is interposed between the arm members 122 and 124, and a back cushion 128 and seat member 130 composed of a seat platform 210 and a seat cushion 133 (FIG. 12) are provided.

Referring to FIG. 19, the front member 120 is provided at one end with the male half 132*a* of a fastening device known commercially as a bed hook. The half 132*a* of the bedhook engages with the female half 132*b* which is secured by screws 134 to the front portion 144 of the inner surface 142 of the right-hand arm member 122. Similarly, the male and female halves 132*a'* and 132*b'* of a bed hook are provided at the other end of the front member 120 and on the front portion 144' of the inner surface 142' of the left-hand arm member 124.

Figure 16:
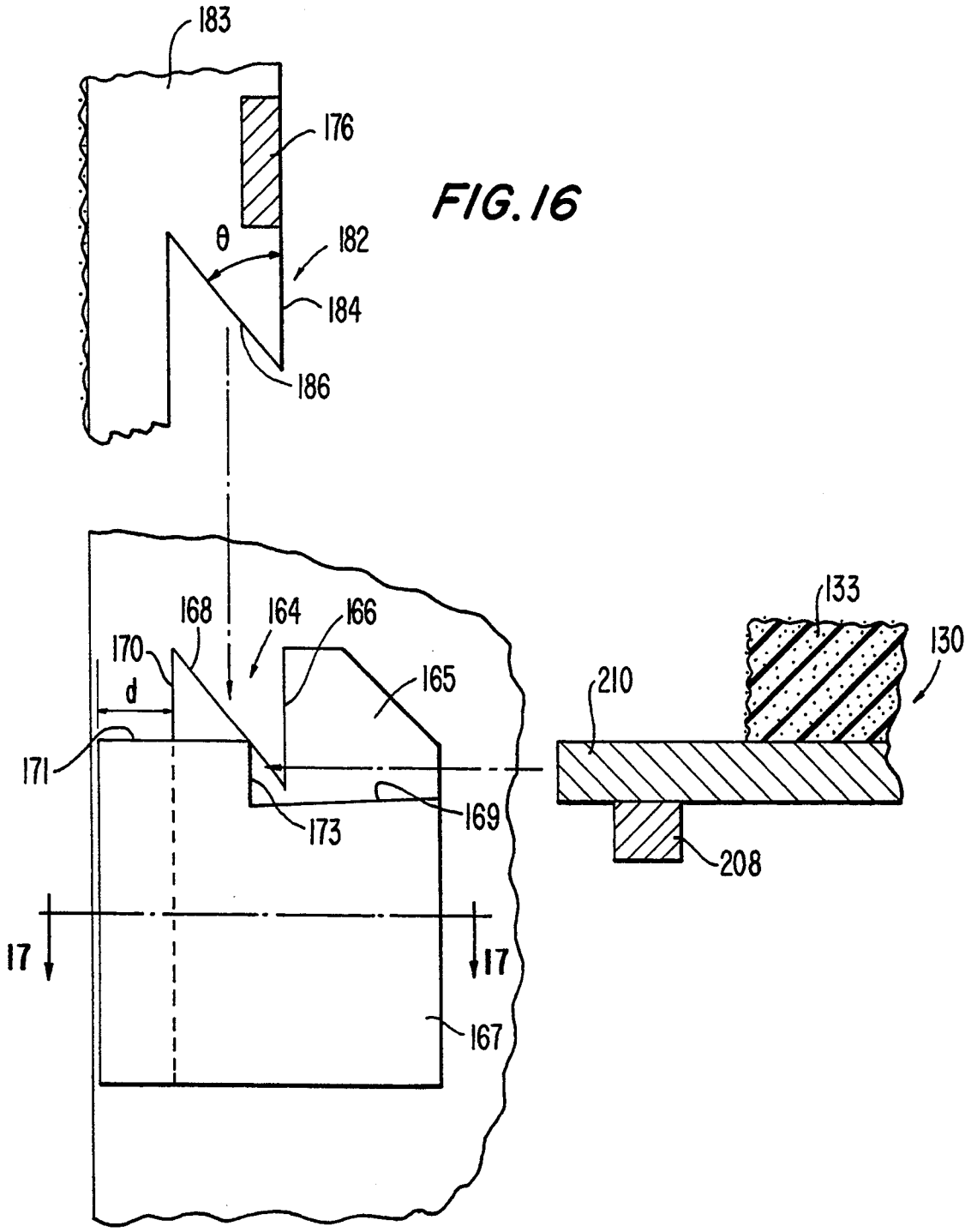
Figure 17:
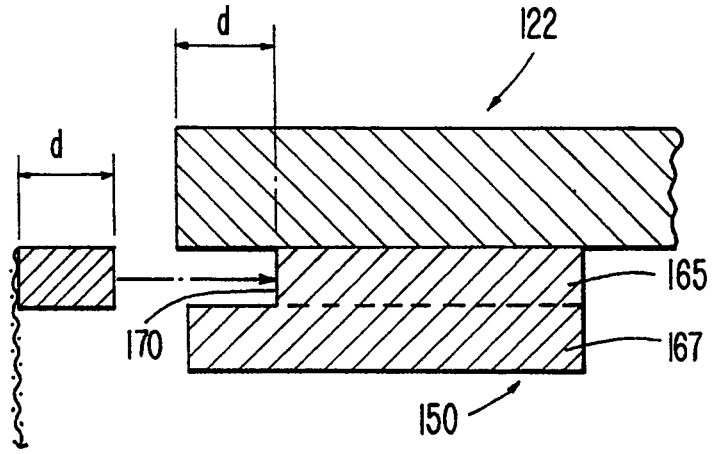
FIG. 17 is a cross-sectional view taken along the plane 17—17 of FIG. 16.

As shown in FIG. 15, a side support member or block 150 is attached to the rear portion 146 of the inner surface of the right-hand arm member 122, and a corresponding side support member or block 150' is attached to the rear portion of the left-hand arm member 124. As best shown in FIGS. 16 and 17, a wedge-shaped socket 164 is provided in a first element 165 of the block 150. Socket 164 is defined by a substantially vertical surface 166 and a sloping surface 168 which makes an acute angle $\theta$ with the vertical surface 166. A second element 167 of side support block 150 is spaced from the arm member 122 by the first element 165 and projects rearward from the end 170 of the first element by a distance less than or equal to d. The second element 167 has first and second upper surfaces 169 and 171 separated by a step 173.

Figures 13, 14:
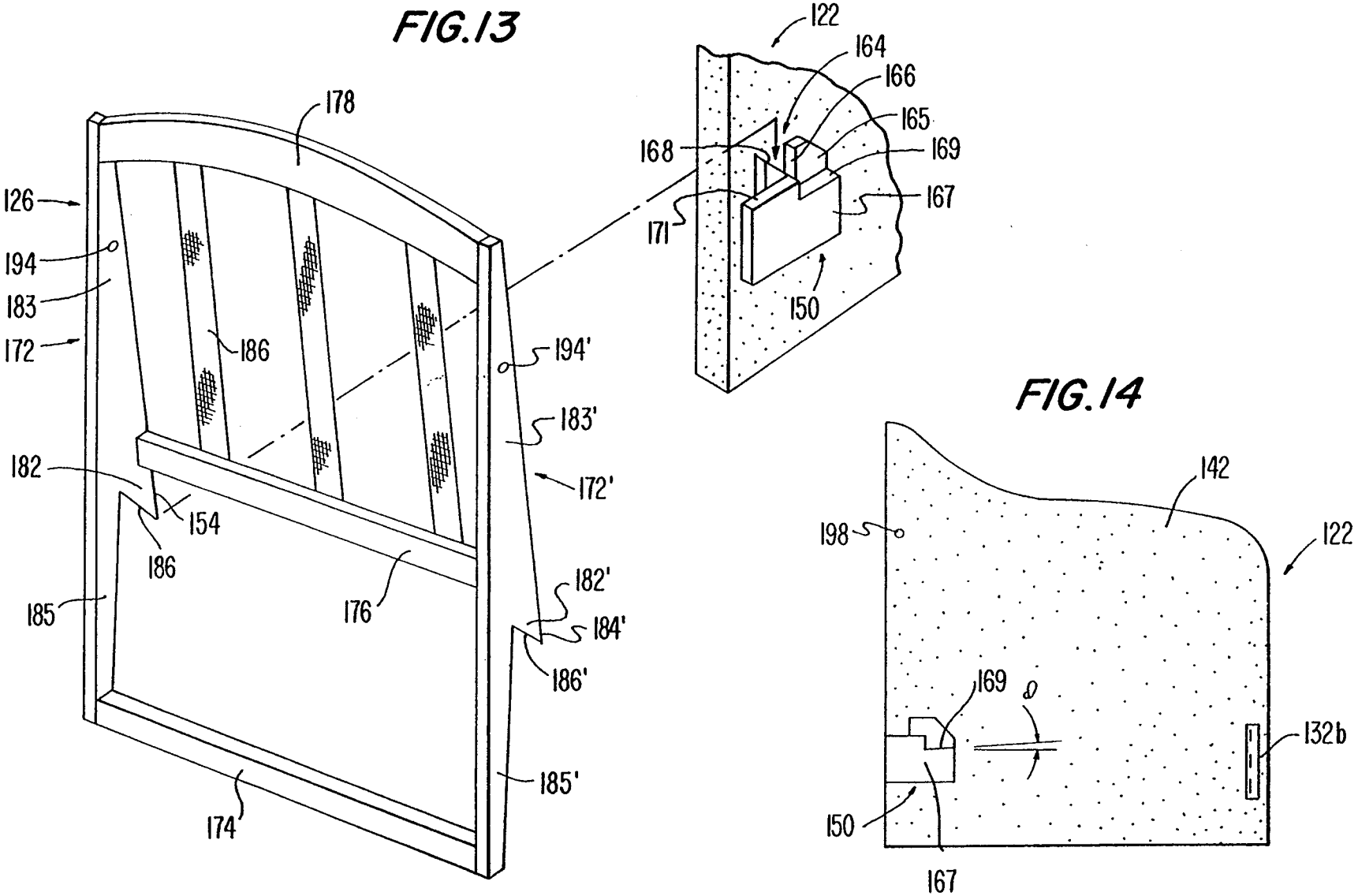
FIG. 13 is an exploded perspective view showing the back member of the chair of FIG. 11 with the upholstery removed and a portion of the right-hand arm member.
FIG. 14 is an elevational view showing the inner surface of the right-hand arm member of the chair of FIG. 11.

The back member 126 is shown in FIG. 13 with the upholstery removed. Back member 126 comprises right and left-hand back vertical side members 172 and 172' respectively, a horizontal bottom rail 174, a horizontal top rail 178 and an intermediate rail 176, rails 174,176 and 178 being interposed between the vertical side members 172 and 172'. Webbing 186, or an equivalent material, is attached between the horizontal top rail 178 and the intermediate rail 176.

The vertical side members 172 and 172' have wedge-shaped projections 182 and 182' located intermediate upper portions 183,183' and lower portions 185, 185' of the vertical side members. Projection 182 is defined by a vertical surface 184 and a sloping surface 186 which makes an acute angle $\theta$ with the surface 184, and projection 182' is defined by a vertical surface 184' and a sloping surface 186' which makes an acute angle $\theta'$ with the vertical surface 184'.

Figure 18:
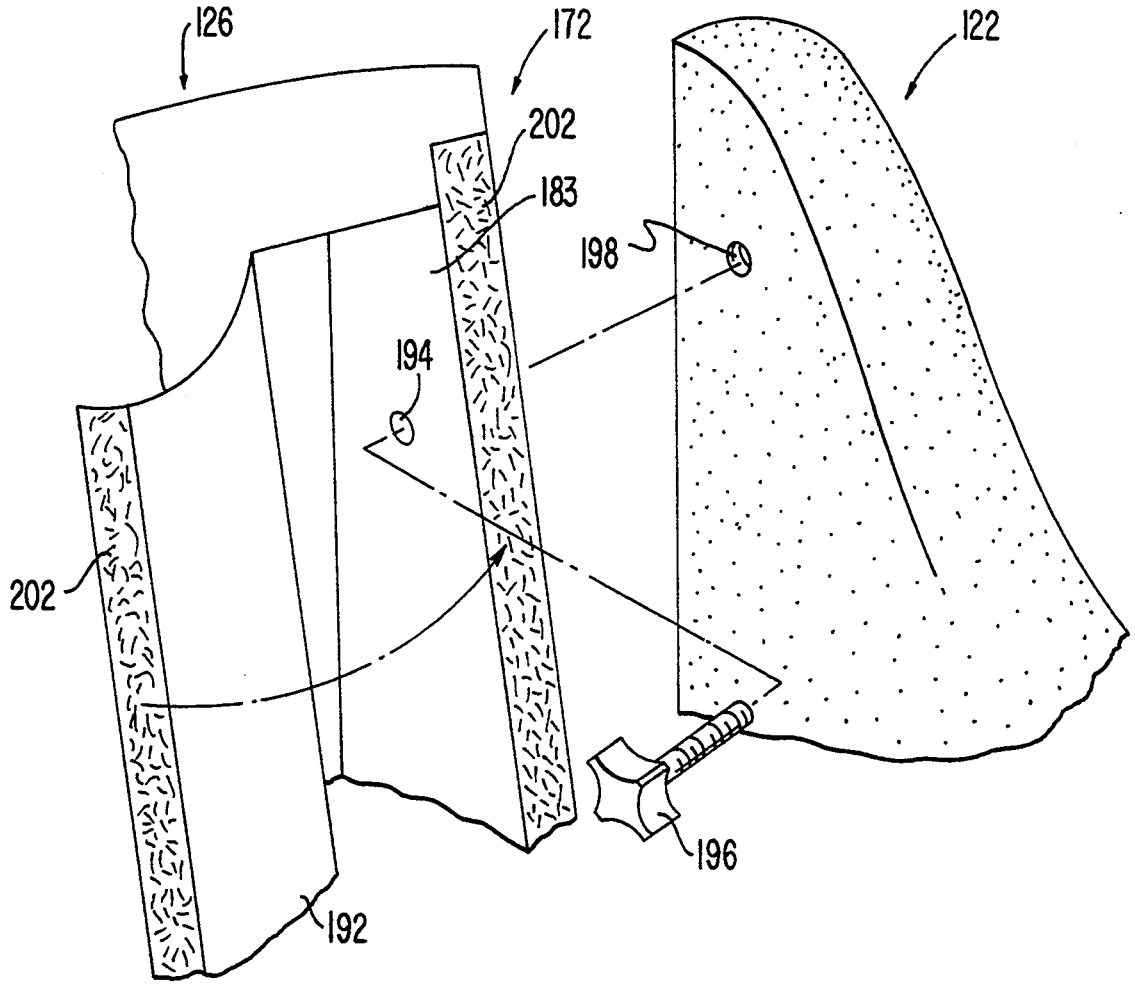
FIG. 18 is a perspective fragmentary view of the back and right-hand arm members of the chair of FIG. 11.

With reference to FIG. 18, the back member 126 may be provided with flaps 192 and 192' which allow access to holes 194 and 194' in vertical side members 172 and 172'. Hole 194 permits a thumb screw 196 to engage a threaded insert 198 in right-hand arm member 122. Similarly, hole 194' permits a thumb screw 196' to engage a threaded insert 198' in left-hand arm member 124. Hook-and-loop strips 202 which, as in the case of the chair shown in FIGS. 1–10 may be made of Velcro or Aplix, are provided on the edges of flaps 192 and on the upholstery of the back member 126 to permit closure of the flaps thereby concealing the thumb screws from view when a back cushion is not in place.

Figure 12:
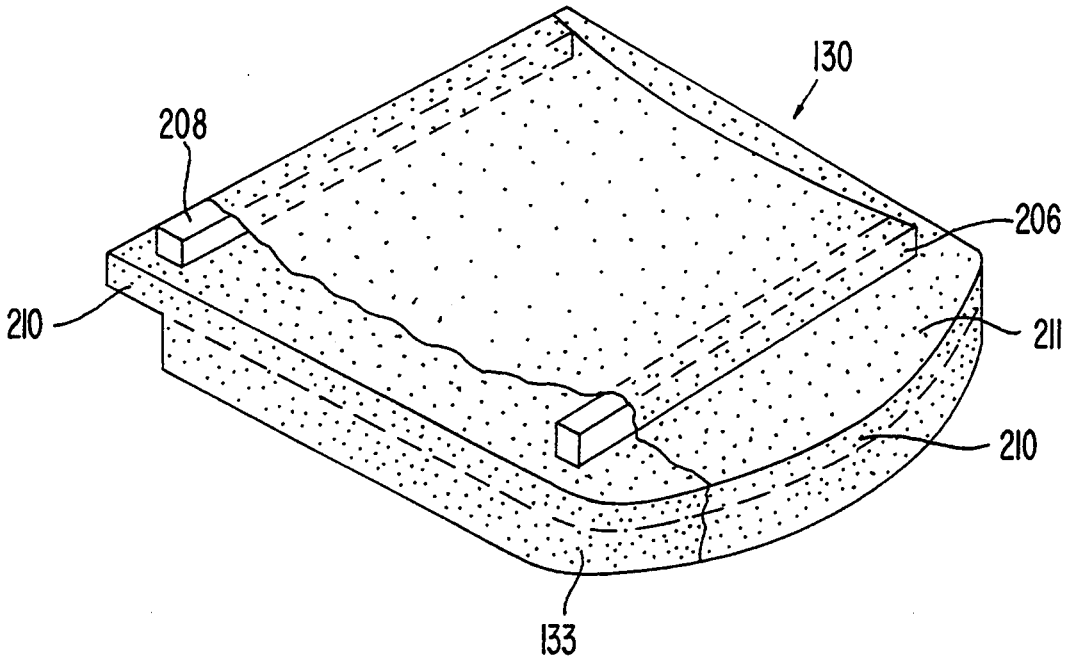
FIG. 12 is a perspective view of the bottom of a first type of seat member for the chair shown in FIG. 11.

The seat member 130, the bottom side of which is shown in FIG. 12, is provided with a seat platform 210 which extends from the rear of the cushion, and has front and rear stabilizer members 206 and 208. The front 211 of the seat platform extends over the front member 120.

To assemble the chair, the back member 126 is lowered on to the side support blocks 150, 150' so that the wedge-shaped projections 182 and 182' of the vertical side members 172 and 172' of the back member mate with the wedge-shaped sockets 164, 164'. Specifically, the sloping surfaces 186, 186' and the vertical surfaces 184, 184 ' of projections 172, 172' are brought into contact with the sloping surfaces 168, 168' and the front vertical surfaces 166,166' of sockets 164 and 164' of the first elements 165, 165' of side support blocks 150, 150'. The lower portions 185 and 185' of the right and left-hand insert sections 172 and 172' are inserted between the rear extensions of the second elements 167, 167' of the side support blocks 150, 150' and the right and left-hand arm members 122 and 124. Thumb screws 196 and 196' are then inserted in holes 194 and 194' and are engaged with the threaded inserts 198, 198' of the arm members 122 and 124, and the flaps 192 closed using the hook-and-loop strips 102.

Then, as shown in FIG. 19, the front member 120 is secured to the right and left-hand arm members 122 and 124 by inserting the male halves 132*a* of the bed hooks attached to the front member into the female halves 132*b* attached to the arm members.

As shown particularly in FIGS. 15 and 16, the assembly is completed by inserting the seat platform 210 of the seat member 130 with its rear end flush against the steps 173, 173' and resting on the upper surfaces 169, 169' of the side support blocks 150, 150'. The rear stabilizer element 208 fits snugly between the second elements 167, 167' of the support blocks and the front stabilizer element behind the front member 120. The front 211 of the seat platform presses downward on the front member 120 when a person sits in the chair and secures the front member in position.

Referring to FIG. 14, the upper surfaces 169,169' of the second elements 167, 167' of the side support blocks 150, 150' is sloped at an angle $\phi$ with the horizontal toward the back of the chair. Consequently, the seat member 130 is lower at the back than at the front resulting in greater comfort for a person sitting on the chair.

As in the case of the wing chair illustrated in FIGS. 1–10, the frame of the chair shown in FIGS. 11–19 supports the weight of the chair and that of a person seated on the seat cushion. Rotational and lateral movement is limited by the cooperation between the wedge-shaped projections 182, 182' and the wedge-shaped sockets 164, 164' and because the lower portions 185, 185 ' of the back insert sections 172, 172' fit snugly between the second elements 167,167' of the blocks 150, 150' and the arm members 122 and 124. The function of the thumb screws 196, 196' is to hold the arm members to the back member of the chair—they support very little of the weight of the chair or of a person seated on it.

Figure 20:
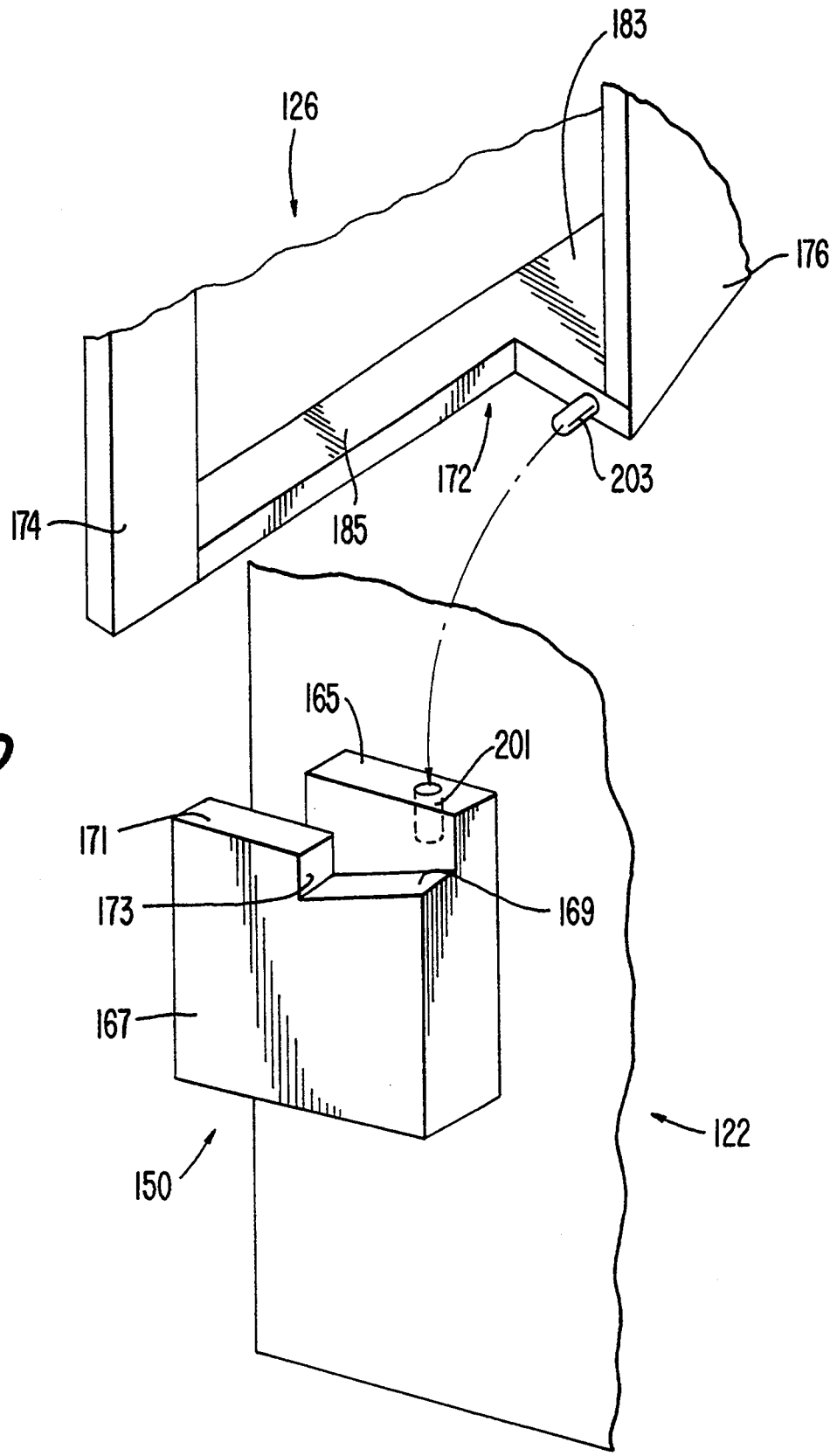
FIG. 20 is a perspective fragmentary view of the chair of FIG. 11 showing another way of attaching the back and right-hand arm members.
Figure 21:
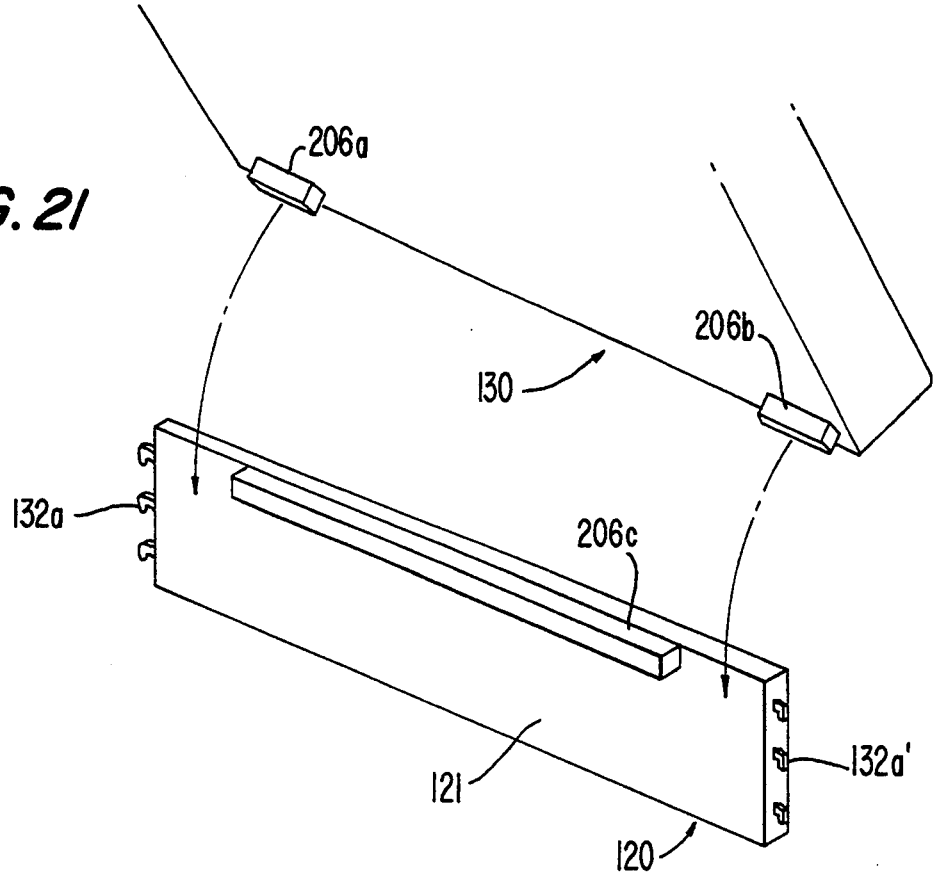
FIG. 21 is a perspective fragmentary view of another type of seat member for the chair of FIG. 11 showing how it is positioned with respect to the front member.

FIG. 20 shows a modification wherein the wedge-shaped sockets and mating wedge-shaped projections are replaced by dowel pins 203,203' which fit into sockets 201, 201'. Another modification is shown in FIG. 21 wherein the front stabilizer element of seat member 130 is replaced by short stabilizing sections **206*a* and 206*b*, and a stabilizing bar 206*c* is attached to the rear surface 121 of the front member 120**. This locks the front panel into position when the seat cushion does not extend beyond the front member.

Figure 22:
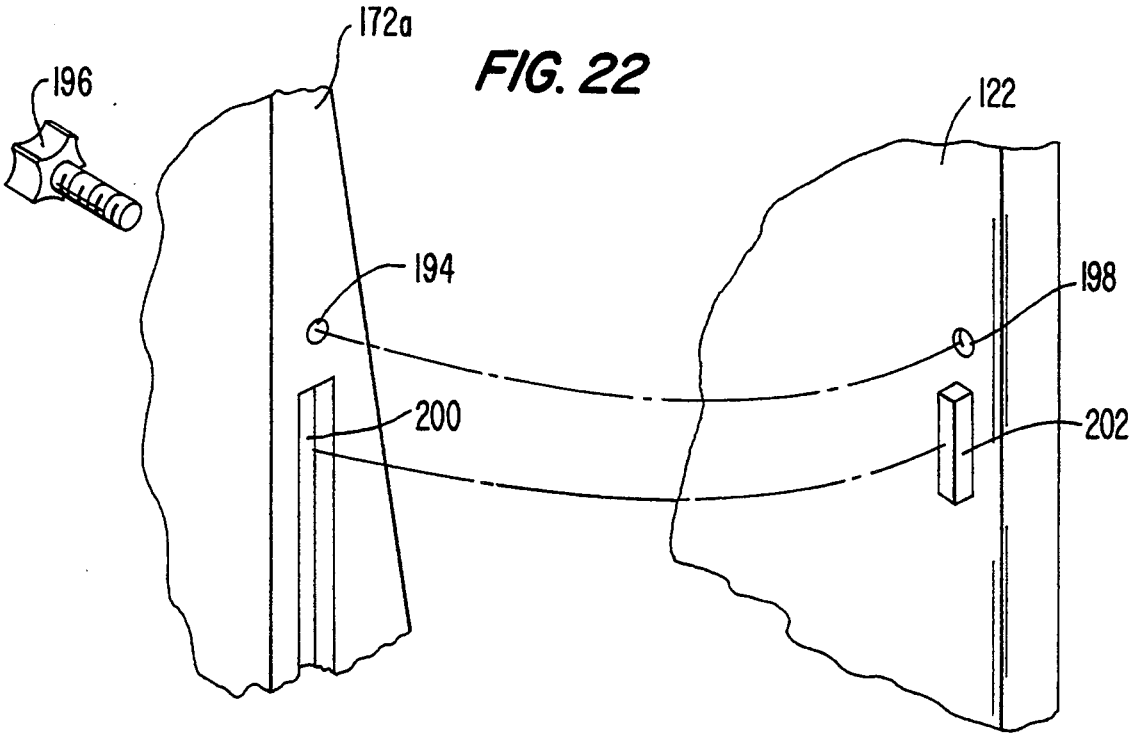
FIG. 22 is a perspective fragmentary view showing another way of attaching the back member to the right-hand arm member of the chair of FIG. 11.

Still another modification is shown in FIG. 22 wherein the right and left vertical side members 172 and 172' are replaced by vertical side members **172*a* and 172*a'* having slotted portions 200, 200' therein for receiving projecting members 202 and 202'** as supplementary frame support.

What is claimed is:

1. An upholstered seating system for mounting on a substantially horizontal surface, said seating system being quickly and easily assembled and disassembled, comprising first and second spaced apart substantially vertical arm members, each of said arm members having an inner surface, a front portion and a rear portion, each of said arm members further including a side support member secured to the rear portion of the inner surface of an arm member, said side support member having an opening therein;

a front member having first and second ends;

a back member including first and second vertical side members, each of said first and second vertical side members having an insertion element for insertion into the vertically extending opening in the side support member of a corresponding arm member;

a seat member resting on said side support members without means attaching said seat member thereto;

first attaching means for removably attaching said front member to said first and second arm members, said first attaching means serving solely for securing said first and second arm members to said front member without supporting said seat member; and second attaching means for removably attaching said back member to said first and second arm members, whereby said seating system is self supporting, said second attaching means serving solely for attaching said arm and back members to each other without supporting said seat member.

2. An upholstered seating system as defined by claim 1 wherein the vertically extending opening in each of said side support members comprises a wedge-shaped socket, said socket having a front vertical inner wall and a rear inner wall spaced from said front vertical wall at the upper part of said opening and sloping downward toward said vertical wall to make an acute angle therewith; and wherein the insertion element of each of the vertical side members of said back member is wedge-shaped for fitting into and mating with the vertically extending opening of a corresponding side support member.

3. An upholstered seating system as defined by claim 2 wherein each of said arm members has a lower edge extending between said front and rear portions thereof, each of said side support members is secured to the lower edge of the inner surface of an arm member and has forward and rearward sections, and which further comprises a seat support member secured to a corresponding side support member at the rearward sections thereof adjacent said wedge-shaped sockets, each of said wedge-shaped sockets having parallel inner walls formed by the lower edge of an arm member and said seat support member.

4. An upholstered seating system as defined by claim 3 wherein said seat member has a seat platform, a rear portion of said platform being supported by said seat support members and a front portion thereof being supported by said front member.

5. An upholstered seating system as defined by claim 4 wherein the front portion of said seat platform is provided with a front stabilizer, said front stabilizer pressing against the front section of said front member to prevent forward displacement thereof.

6. An upholstered seating system as defined by claim 1 wherein each of said arm members has a lower edge extending between said front and rear portions thereof, each of said side support members is secured to the lower edge of the inner surface of an arm member and has forward and rearward sections, and wherein said front member further includes a front section extending perpendicular to said first and second arm members and first and second channel sections, each of said channel sections having a lower flange extending perpendicular to said front section at said first and second ends respectively, said channel sections receiving and supporting on said lower flange the forward sections of the side support members of said first and second arm members.

7. An upholstered seating system as defined by claim 6 wherein the front portion of each of said arm members has a horizontally extending guide aperture therein, and wherein the forward section of each of said side support members extends through the guide aperture of the arm members to which it is secured.

8. An upholstered seating system as defined by claim 1 wherein the inner surface of said back member has a coverable opening therein for accessing said second attaching means.

9. An upholstered seating system as defined by claim 8 which further comprises a back cushion, said back cushion concealing the coverable openings in said back member.

10. An upholstered seating system as defined by claim 1 wherein each of said side support members comprises a first element containing said vertically extending opening and a second element secured to said first element, said second element being spaced from the inner surface of said arm member by said first element to provide a gap therebetween, and wherein said vertical side members are positioned in said gap when said chair is assembled.

11. An upholstered seating system as defined by claim 10 wherein each of said first and second vertical side members has a lower portion, said insertion elements are located at the ends of said lower portions, and wherein the lower portions of said first and second vertical side members are interposed in said gaps when said chair is assembled.

12. An upholstered seating system as defined by claim 10 wherein each of said first and second vertical side members has an upper and lower portion, said insertion element is located intermediate said upper and lower portions, and wherein the lower portions of said first and second vertical side members are positioned in said gap when said chair is assembled.

13. An upholstered seating system as defined by claim 12 wherein said second element has a top surface for supporting said seat member, said seat member having a seat platform and a seat cushion, said top surface having a slope with respect to the horizontal toward the back of the chair, whereby the back of said seat member is lower than the front thereof.

14. An upholstered seating system as defined by claim 1 wherein said insertion element is a cylindrical pin, the vertically extending opening in each of said side support members receiving said pin.

15. An upholstered seating system as defined by claim 1 which further comprises a front stabilizer, said front stabilizer having first and second stabilizing sections attached to one of said front member and said seat member, the other of said seat member and said front member having a stabilizing bar interposed between said first and second stabilizing sections.

16. An upholstered seating system as defined by claim 1 wherein said first and second vertical side members have slots therein, and wherein said arm members are provided with projecting members which fit within said slots, said slots and projecting members providing supplementary support for said seating system.

17. An upholstered seating system as defined by claim 1 which further comprises first and second legs affixed to the first and second ends respectively of said front member.

18. An upholstered seating system as defined by claim 17 which further comprises third and fourth legs affixed to the rear portions of said first and second arm members respectively.

19. An upholstered seating system for mounting on a substantially horizontal surface, said seating system being quickly and easily assembled and disassembled, comprising a front member having first and second ends;

a back member including first and second vertical side members, each of said vertical side members having a first back support means at a lower end thereof;

first and second spaced apart substantially vertical arm members interposed between said front and back members, each of said arm members having an inner surface with a rear portion thereon, each of said arm members further including a side support member and a second back support means secured to the inner surfaces of said arm members, said second back support means being secured to the rear portions of the inner surfaces of said first and second arm members for removably mating with said first back support means for supporting said back member;

a seat member resting on said side support members without means attaching said seat member thereto;

first attaching means for removably attaching said front member to said first and second arm members, said first attaching means serving solely for securing said first and second arm members to said front member without supporting said seat member; and second attaching means for removably attaching said back member to said first and second arm members, said second attaching means serving solely for attaching said arm and back members to each other without supporting said seat member.

* * * * *